US010674242B2

(12) United States Patent
Niu et al.

(10) Patent No.: US 10,674,242 B2
(45) Date of Patent: Jun. 2, 2020

(54) SPEAKER BOX

(71) Applicant: AAC Technologies Pte. Ltd., Singapore (SG)

(72) Inventors: Peng Niu, Shenzhen (CN); Zhichen Chen, Shenzhen (CN); Bin Cai, Shenzhen (CN); Zhe Zhang, Shenzhen (CN); Peng Qin, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/436,894

(22) Filed: Jun. 10, 2019

(65) Prior Publication Data

US 2019/0379957 A1 Dec. 12, 2019

(30) Foreign Application Priority Data

Jun. 12, 2018 (CN) ..... 2018 2 0912131 U

(51) Int. Cl.
*H04R 1/02* (2006.01)
*H04R 1/28* (2006.01)
*H04R 7/04* (2006.01)

(52) U.S. Cl.
CPC ..... *H04R 1/025* (2013.01); *H04R 1/2873* (2013.01); *H04R 7/04* (2013.01)

(58) Field of Classification Search
CPC ..... H04R 1/025; H04R 1/2873; H04R 7/04
USPC ..... 381/386
See application file for complete search history.

(56) References Cited

U.S. PATENT DOCUMENTS

2010/0111334 A1* 5/2010 Simokawatoko ..... H04R 9/025 381/182
2010/0329496 A1* 12/2010 Mottonen ..... H04M 1/0245 381/349
2012/0027243 A1* 2/2012 Imamura ..... H04R 1/2803 381/389
2013/0308812 A1* 11/2013 Shen ..... H04R 1/288 381/346
2014/0037119 A1* 2/2014 Yuasa ..... H04R 1/02 381/346
2015/0358721 A1* 12/2015 Wang ..... H04R 1/2876 381/346
2016/0309254 A1* 10/2016 Lembacher ..... H04R 1/222
2019/0174233 A1* 6/2019 Fukuda ..... H04R 1/00
2019/0261084 A1* 8/2019 Ozcan ..... H04R 3/04

* cited by examiner

*Primary Examiner* — Sean H Nguyen
(74) *Attorney, Agent, or Firm* — W&G Law Graup LLP

(57) ABSTRACT

The present disclosure discloses a speaker box, including a housing with an accommodation space. The housing includes an upper case and a lower case. A speaker is received in the accommodation space. The speaker includes a diaphragm for producing sound. The speaker box further includes a passageway, a front sound cavity formed between the diaphragm and the upper case, a front cavity, a receiving slot formed in the upper case recessing from a side of the upper case adjacent to the diaphragm along a direction away from the diaphragm; and an air adsorbing layer received in the receiving slot, a steel piece engaging with the upper case and packaging the air adsorbing layer in the receiving slot, and a number of air adsorbing holes for communicating with the front sound cavity.

6 Claims, 3 Drawing Sheets

SPEAKER BOX

FIELD OF THE PRESENT DISCLOSURE

The present disclosure relates to the field of electromagnetic transducers, more particularly to a speaker box used in a portable electronic device.

DESCRIPTION OF RELATED ART

A speaker is a very important component equipped in a mobile phone for producing audible sounds. A speaker generally uses a diaphragm to produce vibration and further to generate sounds.

A speaker box is a component containing a speaker and a housing receiving the speaker. Compared to a speaker, a speaker box has a relatively larger back volume and better low frequency acoustic performance. The speaker box has a sound aperture for radiating sound. The speaker assembly is generally a long-and-narrow configuration and placed deviating from a center of the housing for balancing the acoustic performance and the occupation.

In the related speaker box, the speaker includes a diaphragm forming a front sound cavity with the housing. The speaker box includes a sound passageway communicated with the front sound cavity. The front sound cavity and the sound passageway cooperatively form a front cavity. Such a front cavity includes rigid inner sides made of hard plastic or metallic material. Such a rigid side has lower damping rate and has limited radiation power, which make it difficult to radiate the power inside the cavity to outside. Further, the rigid sides will cause harmonic peak at high frequency, which will cause distortion and badly affect the acoustic performance of the speaker box.

Therefore, an improved speaker box is desired.

SUMMARY OF THE PRESENT DISCLOSURE

One of the primary objects of the present disclosure is to provide a speaker box capable of reducing distortion and improving acoustic performance.

Therefore, the present disclosure provides a speaker box, including: a housing with an accommodation space, including an upper case and a lower case; a speaker received in the accommodation space, including a diaphragm for producing sound; a passageway formed in the accommodation space; a front sound cavity formed between the diaphragm and the upper case; a front cavity formed by the passageway and the front sound cavity; a receiving slot formed in the upper case recessing from a side of the upper case adjacent to the diaphragm along a direction away from the diaphragm; an air adsorbing layer received in the receiving slot; a steel piece engaging with the upper case and packaging the air adsorbing layer in the receiving slot; and a plurality of air adsorbing holes penetrating the steel piece for communicating with the front sound cavity.

Further, the plurality of air adsorbing holes are arranged in a matrix.

Further, the upper case includes a main body engaging with the lower case and a steel plate fixed to the main body adjacent to the diaphragm; the main body includes a through hole facing the diaphragm and covered completely by the steel plate; the passageway is formed in the upper case; the steel plate further includes a receiving slot recessing along a direction away from the diaphragm.

Further, the diaphragm includes a dome and a vibration portion extending from an edge of the dome, and the air adsorbing holes face the dome.

Further, a height of the air adsorbing layer is substantially equal to a depth of the receiving slot.

Further, the air adsorbing layer is made of air adsorbing cotton.

BRIEF DESCRIPTION OF THE DRAWINGS

Many aspects of the exemplary embodiment can be better understood with reference to the following drawings. The components in the drawing are not necessarily drawn to scale, the emphasis instead being placed upon clearly illustrating the principles of the present disclosure.

DETAILED DESCRIPTION OF THE EXEMPLARY EMBODIMENT

The present disclosure will hereinafter be described in detail with reference to an exemplary embodiment. To make the technical problems to be solved, technical solutions and beneficial effects of the present disclosure more apparent, the present disclosure is described in further detail together with the figure and the embodiment. It should be understood the specific embodiment described hereby is only to explain the disclosure, not intended to limit the disclosure.

Figure 1:
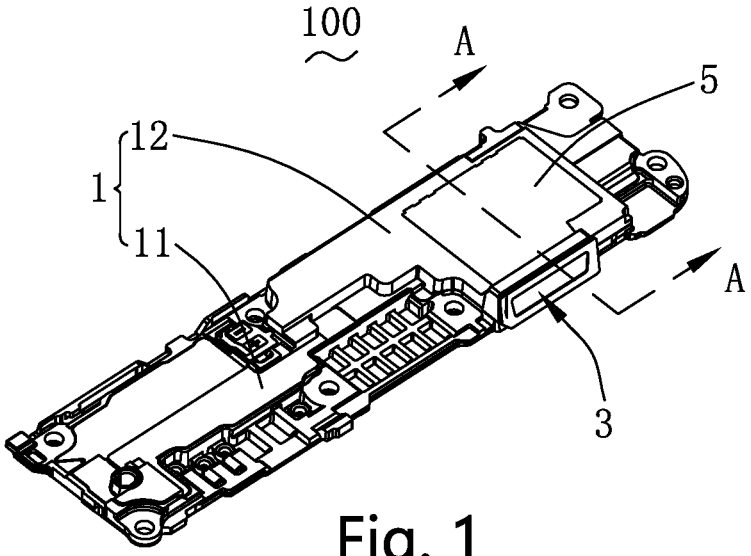
FIG. 1 is an isometric and exploded view of a speaker box in accordance with an exemplary embodiment of the present disclosure.
Figure 2:
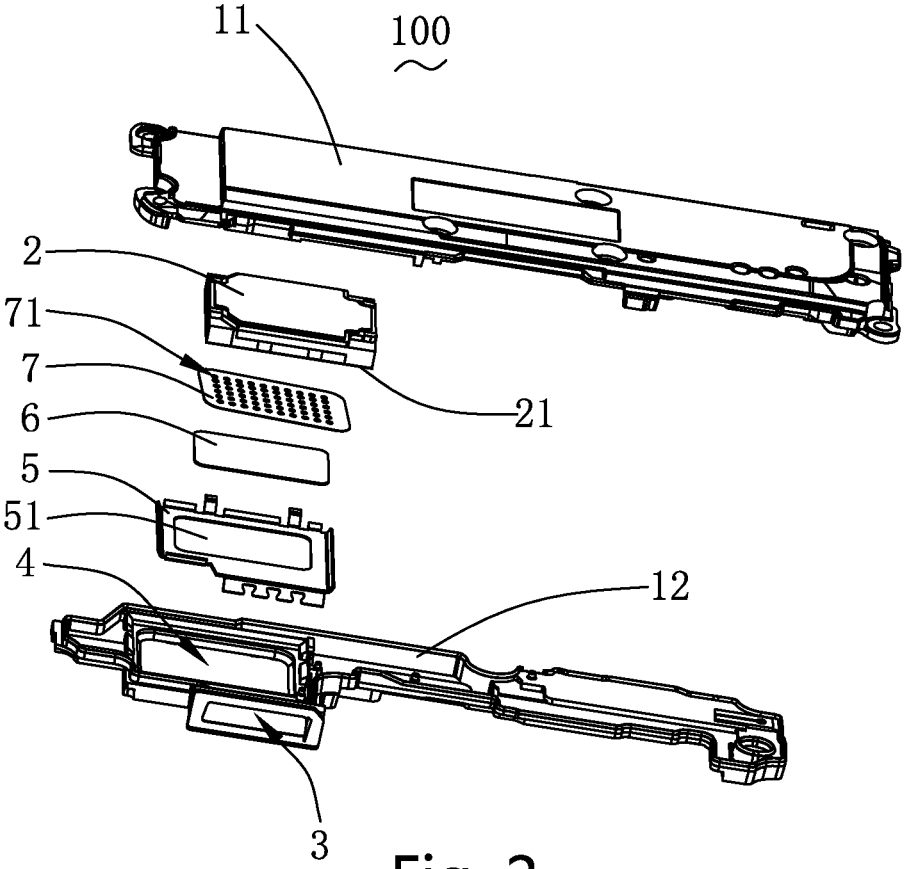
FIG. 2 is an isometric view of the speaker box in FIG. 1.
Figure 3:
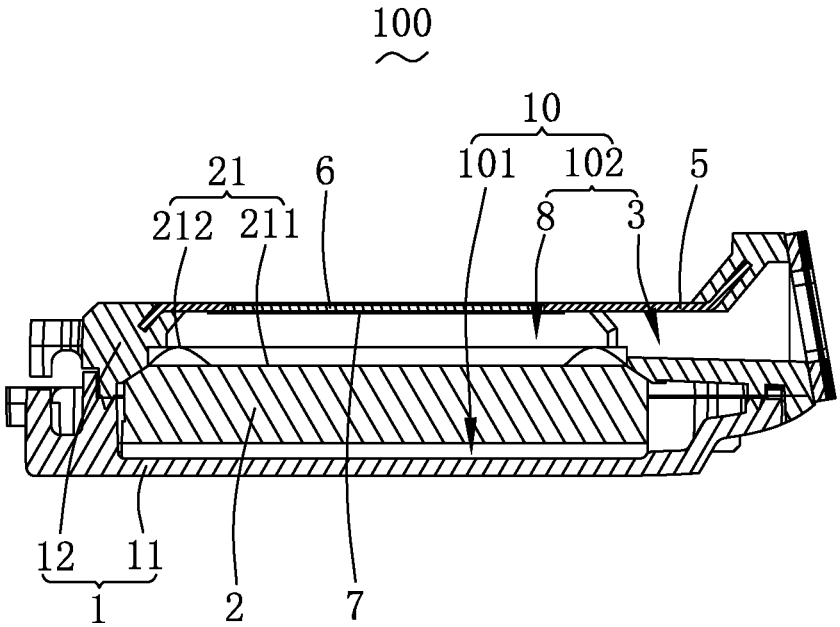
FIG. 3 is a cross-sectional view of the speaker box, taken along line A-A in FIG. 1.

Referring to FIGS. 1-3, a speaker box 100 in accordance with an exemplary embodiment of the present disclosure includes a housing 1, a speaker 2, a passageway 3, a through hole 4, a steel plate 5, an air adsorbing layer 6, and a steel piece 7.

The housing 1 includes an accommodation space 10 for receiving the speaker 2 therein. The housing is an integral structure. Optionally, the housing 1 can also be assembled by separated parts. In the embodiment, the housing 1 includes a lower case 11, an upper case 12 forming the accommodation space 10 with the lower case 11.

The speaker 2 includes a diaphragm 21 for producing sounds. The diaphragm 21 forms a front sound cavity 8 together with the housing 1. Specifically, the diaphragm 21 forms the front sound cavity 8 together with the upper case 12. The diaphragm 21 forms a back cavity 101 together with the upper case and the lower case. The diaphragm 21 includes a dome 211 and a vibration portion 212 extending from an edge of the dome 211.

The passageway 3 is formed in the accommodation space 10 of the housing 1. In the embodiment, the passageway 3 is formed in the upper case 12.

The passageway 3 communicates the front sound cavity 8 and outside of the speaker box for achieving side-sounding structure. The passageway 3 and the front sound cavity 8 cooperatively form a front cavity 102. In the embodiment, the diaphragm 21 divides the accommodation space 10 into the front cavity 102 and the back cavity 101. The front cavity 102 includes a front sound cavity 8 and the passageway 3 for outputting sound. The back cavity 101 is used for improving the low frequency acoustic performance of the speaker box 100.

The through hole 4 penetrates the housing 1 and communicates with the front sound cavity 8. In the embodiment, the through hole 4 penetrates the upper case 12 and faces the diaphragm 21. Optionally, the through hole 4 faces the dome 211.

Alternatively, the through hole 4 can also be arranged in the upper case 12 corresponding to the passageway 3.

The steel plate 5 is fixed with the housing 1 and completely covers the through hole 4. In the embodiment, the steel plate 5 is fixed to the upper case 12. Another word, the upper case 12 includes a main body 121 engaging with the lower case 11 and the steel plate 5 fixed with the main body 121 adjacent to the diaphragm 21. The through hole 4 penetrates the main body 121 facing the diaphragm 21. The steel plate 5 completely covers the through hole 4.

The steel plate 5 forms a receiving slot 51 recessed from a side adjacent to the diaphragm 21 toward a direction away from the diaphragm 21. Optionally, the receiving slot 51 is formed in the upper case.

Kindly be noted that the steel plate 5 in the present disclosure is not limited to a plate made of steel. The steel plate 5 includes plate made of other materials with high stiffness. More specifically, it is required that Yong's module of the plate should be higher than the Young's module of the housing 1.

The air adsorbing layer 6 is received in the receiving slot 51. The air adsorbing layer 6 is made of air adsorbing materials, like air adsorbing cotton. The air adsorbing layer 6 is used for breaking the resonance conditions o the front sound cavity 8 to improve high frequency resonance. Further, the air adsorbing layer 6 is used for adsorb vibrations at specific frequency, to reducing distortion occurred at high frequency.

The air adsorbing layer 6 has a resonance frequency, and at near the resonance frequency, the air adsorbing layer 6 can vibrate mightily. During the sound generating period of the speaker box, the air adsorbing layer 6 brings the power produced by the vibration of the diaphragm near the resonance frequency to outside of the front sound cavity, by which the purpose of adsorbing power produced at near the resonance frequency is achieved. Accordingly, the questions of harmonic peaks, distortions are solved. In fact, in the embodiment, the air adsorbing layer 6 is used to replace a part of the steel plate 5 for transmitting the change of density of the air in the front sound cavity 8 to outside of the front cavity 102. Accordingly, the distortion is improved.

In the embodiment, a height of the air adsorbing layer 6 is substantially equal to a depth of the receiving slot 51 for reducing the thickness of the steel plate as much as possible and at the same time ensuring the height of the front sound cavity 8.

The steel piece 7 is fixed to the steel plate 5 and completely covers the air adsorbing layer 6 for packaging the air adsorbing layer 6 in the receiving slot 51. The steel piece 7 includes an air adsorbing hole 71 communicating with the front sound cavity 8. In the embodiment, the air adsorbing hole 71 faces the dome 211. Such a configuration improves high frequency resonance and distortion.

The air adsorbing hole 71 may include a plurality of small holes arranged in a matrix.

Figure 4:
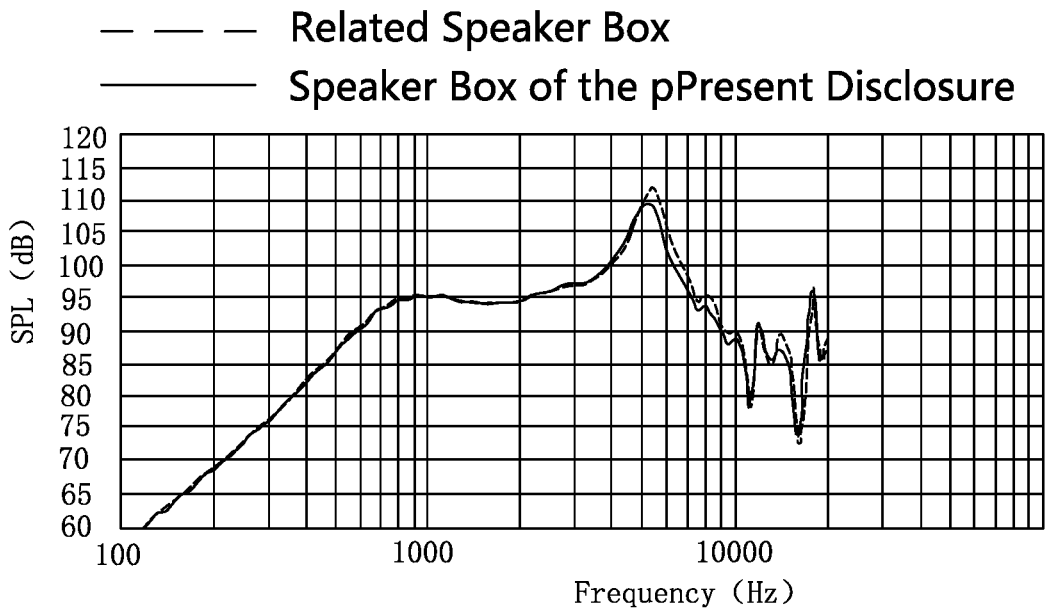
FIG. 4 is the frequency-resonance curve of the speaker box.
Figure 5:
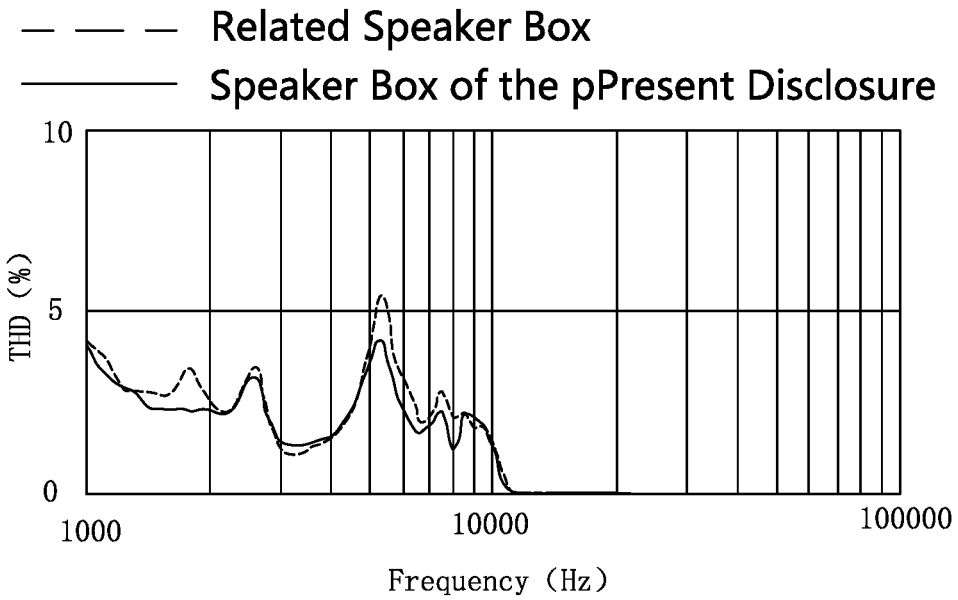
FIG. 5 is the harmonic distortion curve of the speaker box.

Referring to FIGS. 4-5, the configuration of the present disclosure improves the resonance distortion and ensure the acoustic performance.

Generally, the width of the frequency band of the speaker box 100 is 800 Hz~1000 Hz. More flatter the frequency-resonance curve is, better acoustic performance is obtained. Because of the front cavity of such a side-sounding speaker box, the frequency-resonance peak occurs at the frequency near 4-7 Hz. Referring to FIG. 4, frequency-resonance peak is obviously reduced. Referring to FIG. 5, the distortion is improved.

During the sound generating period of the speaker box, the air adsorbing layer brings the power produced by the vibration of the diaphragm near the resonance frequency to outside of the front sound cavity, by which the purpose of adsorbing power produced at near the resonance frequency is achieved. Accordingly, the questions of harmonic peaks, distortions are solved. In fact, in the embodiment, the air adsorbing layer is used to replace a part of the steel plate for transmitting the change of density of the air in the front sound cavity to outside of the front cavity. Accordingly, the distortion is improved.

It is to be understood, however, that even though numerous characteristics and advantages of the present exemplary embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. A speaker box, including:

a housing with an accommodation space, including an upper case and a lower case;

a speaker received in the accommodation space, including a diaphragm for producing sound;

a passageway formed in the accommodation space;

a front sound cavity formed between the diaphragm and the upper case;

a front cavity formed by the passageway and the front sound cavity;

a receiving slot formed in the upper case recessing from a side of the upper case adjacent to the diaphragm along a direction away from the diaphragm;

an air adsorbing layer received in the receiving slot;

a steel piece engaging with the upper case and packaging the air adsorbing layer in the receiving slot;

a plurality of air adsorbing holes penetrating the steel piece for communicating with the front sound cavity.

2. The speaker box as described in claim 1, wherein the plurality of air adsorbing holes are arranged in a matrix.

3. The speaker box as described in claim 1, wherein the upper case includes a main body engaging with the lower case and a steel plate fixed to the main body adjacent to the diaphragm; the main body includes a through hole facing the diaphragm and covered completely by the steel plate; the passageway is formed in the upper case; the steel plate further includes a receiving slot recessing along a direction away from the diaphragm.

4. The speaker box as described in claim 3, wherein the diaphragm includes a dome and a vibration portion extending from an edge of the dome, and the air adsorbing holes face the dome.

5. The speaker box as described in claim 3, wherein a height of the air adsorbing layer is substantially equal to a depth of the receiving slot of the steel plate.

6. The speaker box as described in claim 1, wherein the air adsorbing layer is made of air adsorbing cotton.

* * * * *